US010406575B2

(12) United States Patent
Burgstaller et al.

(10) Patent No.: US 10,406,575 B2
(45) Date of Patent: Sep. 10, 2019

(54) WIRE DRAWING DEVICE

(71) Applicant: Steinklauber Industriebeteiligung & Vermögensverwaltung GmbH, Graz (AT)

(72) Inventors: Adolf Burgstaller, Graz (AT); Hans Peter Pichler, Graz (AT)

(73) Assignee: STEINKLAUBER INDUSTRIEBETEILIGUNG & VERMÖGENSVERWALTUNG GMBH, Graz (AT)

( * ) Notice: Subject to any disclaimer, the term of this patent is extended or adjusted under 35 U.S.C. 154(b) by 0 days.

(21) Appl. No.: 14/386,973

(22) PCT Filed: Mar. 22, 2013

(86) PCT No.: PCT/AT2013/050071
§ 371 (c)(1),
(2) Date: Jan. 29, 2015

(87) PCT Pub. No.: WO2013/138836
PCT Pub. Date: Sep. 26, 2013

(65) Prior Publication Data

US 2015/0158066 A1 Jun. 11, 2015

(30) Foreign Application Priority Data

Mar. 23, 2012 (AT) ..... 50097/2012

(51) Int. Cl.
*B21C 1/06* (2006.01)
*B21C 1/12* (2006.01)
(Continued)

(52) U.S. Cl.
CPC ..... *B21C 3/12* (2013.01); *B21C 1/06* (2013.01); *B21C 1/12* (2013.01); *B21C 9/00* (2013.01); *B21F 99/00* (2013.01)

(58) Field of Classification Search
CPC .... B21C 1/02; B21C 1/04; B21C 1/08; B21C 1/12; B21C 1/14; B21C 3/12; B21C 3/14; B21C 1/06; B21C 9/00; B65H 59/225
(Continued)

(56) References Cited

U.S. PATENT DOCUMENTS 1,943,029 A * 1/1934 McIlvried ..... B21C 47/003 192/85.23
2,047,374 A * 7/1936 Larsen ..... B21C 1/12 72/17.3
(Continued)

FOREIGN PATENT DOCUMENTS

CN 2 925 663 7/2007
CN 2 925 665 7/2007
(Continued)

OTHER PUBLICATIONS

English translation of JP 63-010020.*
(Continued)

*Primary Examiner* — Gregory D Swiatocha
(74) *Attorney, Agent, or Firm* — Greenblum & Bernstein, P.L.C.

(57) ABSTRACT

The invention relates to a device (1) for drawing wire (5), comprising a plurality of cone pairs (2, 3, 4) arranged in a row and drawing dies (23, 33, 43) arranged between cones (21, 22, 31, 32, 41, 42) of a cone pair (2, 3, 4), wherein wire (5) being drawn extends from one cone pair (2, 3, 4) to the next cone pair (2, 3, 4). According to the invention, a motor (6, 7, 8) is provided for each cone pair (2, 3, 4) in order to drive said cone pair (2, 3, 4).

15 Claims, 6 Drawing Sheets

Figure 1:
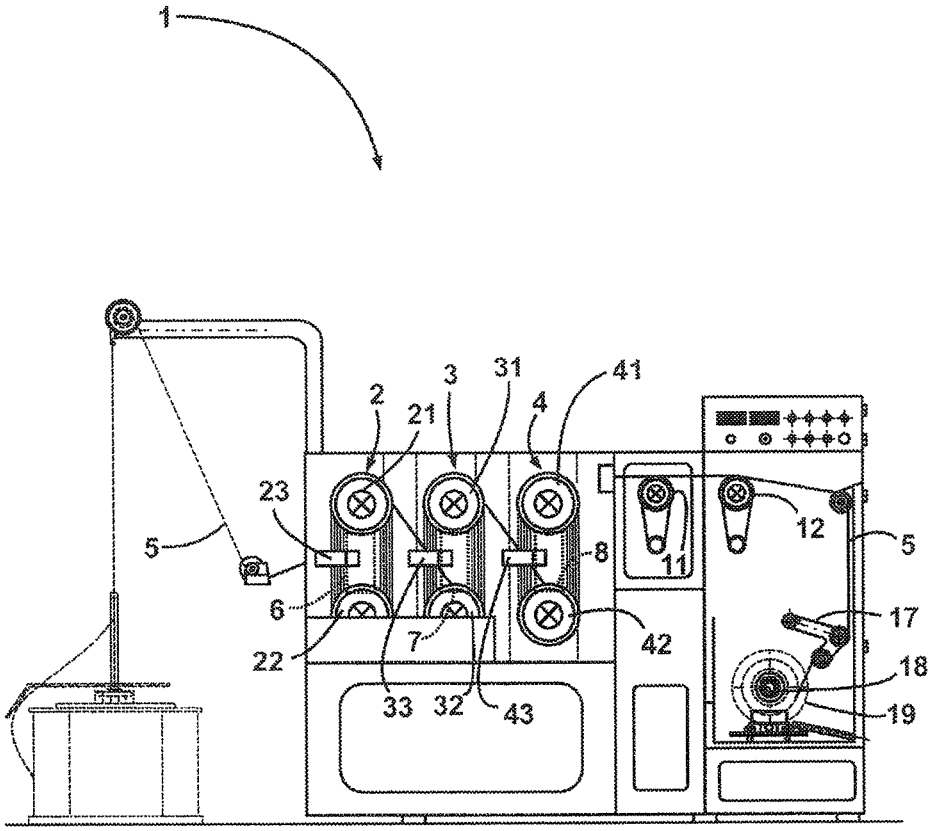

(51) Int. Cl.
*B21C 3/12* (2006.01)
*B21C 9/00* (2006.01)
*B21F 99/00* (2009.01)

(58) Field of Classification Search
USPC ..... 72/289; 73/862.391, 42, 44, 451
See application file for complete search history.

(56) References Cited

U.S. PATENT DOCUMENTS

| | | | | | |
|---|---|---|---|---|---|
| 2,107,799 | A * | 2/1938 | Pierson | B21C 3/14 | 72/278 |
| 2,186,106 | A * | 1/1940 | Hargreaves | B21C 1/10 | 242/364.9 |
| 2,247,248 | A * | 6/1941 | Morgan | B21C 1/14 | 72/289 |
| 2,530,624 | A * | 11/1950 | Morgan | B21C 1/14 | 72/289 |
| 3,143,204 | A * | 8/1964 | Bruestle | B21C 1/14 | 72/286 |
| 3,213,663 | A | 10/1965 | Coan | | |
| 3,368,382 | A * | 2/1968 | Fleshman | B21C 1/14 | 72/286 |
| 3,686,908 | A * | 8/1972 | Krafft | B21C 9/00 | 72/278 |
| 3,798,939 | A | 3/1974 | Mertens et al. | | |
| 4,662,203 | A | 5/1987 | Kanatani et al. | | |
| 4,750,344 | A * | 6/1988 | Thompson | B21C 1/12 | 72/280 |
| 5,628,219 | A | 5/1997 | Fink et al. | | |
| 6,216,506 | B1 * | 4/2001 | Stevens | B21C 1/10 | 72/19.2 |
| 6,892,589 | B2 * | 5/2005 | Turunen | G01M 11/088 | 242/474.7 |
| 7,832,675 | B2 * | 11/2010 | Bumgarner | B65H 54/88 | 242/157.1 |
| 2002/0007657 | A1 * | 1/2002 | McCabe | B21C 1/04 | 72/281 |
| 2007/0240478 | A1 * | 10/2007 | Kalweit | B21C 1/02 | 72/289 |
| 2011/0219838 | A1 * | 9/2011 | Aichele | B21D 51/2615 | 72/94 |

FOREIGN PATENT DOCUMENTS

| | | |
|---|---|---|
| CN | 102 233 361 | 11/2011 |
| CN | 202 061 915 | 12/2011 |
| CN | 102 327 909 | 1/2012 |
| CN | 102 363 166 | 2/2012 |
| DE | 1 915 072 | 10/1970 |
| DE | 197 53 008 | 6/1998 |
| DE | 198 01 737 | 7/1999 |
| DE | 10 2007 019 289 | 10/2008 |
| JP | UM S52-129740 | 3/1951 |
| JP | S62-263819 | 11/1987 |
| JP | 63-010020 | 1/1988 |
| JP | 043 22812 | 11/1992 |
| JP | H10-128623 | 5/1998 |
| JP | 2009-113084 | 5/2009 |
| WO | 89/12514 | 12/1989 |

OTHER PUBLICATIONS

Japan Office Action (Decision of Refusal) conducted in counterpart Japan Appln. No. 2015-500713 (dated Dec. 14, 2016) (w/ English translation).
Japan Office Action (Notice of Reasons for Rejection) conducted in counterpart Japan Appln. No. 2015-500713 (dated Dec. 20, 2016) (w/ English translation).
China First Office Action conducted in counterpart China Appln. No. 201380026812.7 (dated Aug. 31, 2015) (w/ English translation).
China Second Office Action conducted in counterpart China Appln. No. 201380026812.7 (dated May 3, 2016) (w/ English translation).
China Third Office Action conducted in counterpart China Appln. No. 201380026812.7 (dated Nov. 2, 2016) (w/ English translation).
China Fourth Office Action conducted in counterpart China Appln. No. 201380026812.7 (dated Mar. 17, 2017) (w/ Engl. translation).
Austria Office Action conducted in counterpart Austria Appln. No. A 50097/2012 (dated Jan. 18, 2013) (w/ machine translation).

* cited by examiner

WIRE DRAWING DEVICE

The invention relates to a device for drawing wire, comprising multiple cone pairs arranged in a row and drawing dies arranged between cones of a cone pair, wherein wire that is to be drawn runs from one cone pair to the next cone pair.

Devices of the type named at the outset are usually embodied as wet drawing machines, wherein a central drive is provided and operation occurs according to the sliding wire drawing principle, that is, with a slip between the wire and the pulling disc. Drawing machines of this type comprise multiple (drawing) cones, via which the wire is guided in a coiling manner and is drawn through drawing dies or drawing tools arranged next to one another in the wire path to reduce its cross section. Because of a tapered cross section in the individual drawing dies in the direction of wire travel, a defined wire elongation results. In accordance with this wire elongation of the cone pairs arranged one after another, the rotational speeds of the same also need to be increased. Within a cone pair, an increase in the speed of the wire, and therefore a circumferential speed matched to the wire path area, is achieved at the cone circumference via ascending cone diameter steps.

Normally, with conical wire drawing machines, an operation of the cones with a certain slip (that is, a higher rotational speed than is absolutely necessary) in relation to the wire is normally essential. By setting a slip, it is taken into consideration that the cones and the drawing dies are subjected to a wear that may also vary. However, the slip is to be minimized. At the last cone block in the drawing direction or a downstream drawing-off disc or drawing-out disc, however, no more slip should be present.

A disadvantage in the case of a fixed slip is that, because a constant machine slip is predefined, a total slip across the cone discs increases continuously in an unfavorable manner due to a necessary predefined technological slip in the direction of a decreasing wire diameter. This has a negative effect on a surface quality of the finished wire and influences the wire properties, the drawing disc wear, the machine-specific drawability, the energy use and the risk of wire breakage during the drawing process in an equally negative fashion.

A structural adjustment of a wet drawing device to different operating states, or a slip adjustment as disclosed, for example, in DE 197 53 008 A1, proves to be difficult in practice and is also inflexible in respect of a change in process parameters.

A more suitable method for defining a slip and ultimately also a loading of the wire passing through a wet drawing device, is a regulation of individual drive units, as this is disclosed in DE 10 2007 019 289 A1. In the case of a wet drawing device according to said document, exactly one driving motor is assigned to each drawing cone. Furthermore, a regulation is provided with which, as a function of a rotational speed of a drawing-out disc arranged downstream from the cones, a regulation of the drive units of the drawing cones, and therefore also of the slip, occurs. A wet drawing device of this type allows the slip to be adjusted; however, the regulation is complicated and the device is expensive overall due to the necessary number of drives. In particular, the complexity of the regulation of the drives interacting with one another and a high stress on the wire that is to be drawn, with the associated risk of a wire tear, are disadvantageous in the case of this wet drawing device.

The object of the invention is to disclose a device of the type named at the outset, for which a slip at individual cone pairs can be optimized by simple means so that fine wires and ultra-fine wires, particularly those made of steel, can be produced with high process reliability and good surface qualities, the lowest possible torsion, and low residual stress.

This object is attained according to the invention if, in a device of the type named at the outset, one motor is provided for each cone pair in order to drive the cone pair.

With the embodiment according to the invention of a device or a wet drawing machine, altered process parameters, for example caused by wear or clogging of drawing dies, can be accounted for in a simple manner. At the same time, a device-related cost is thereby minimized, as each cone pair is driven by a separate motor. For this purpose, the individual drive units are operated in a controlled and deviation-neutral manner in relation to the process parameters so that a slip can also be minimized. It is thereby possible to create wires with outstanding surface qualities at a high production speed. High production speeds can thereby also be achieved because the wire that is to be pulled is subjected to a smaller load in contrast to individual cones respectively provided and operated with one drive.

The individual cones can essentially be embodied in multiple pieces from individual discs having a different diameter. However, for the sake of a simple exchangeability of the cones, it is preferred if these cones are embodied in one piece.

An arrangement of the cones of a cone pair can occur in any desired manner. For example, the cones can be arranged next to one another. However, it is advantageous, again in terms of a lowest possible loading of the wire that is to be pulled, if the cones of a cone pair are arranged above one another. Furthermore, an optimal flushing of the drawing dies can be ensured by means of a perpendicular drawing direction directed from bottom to top. Abraded particles can be reliably removed from the deformation zone, which has a positive effect on the service lives of the drawing dies.

It has proven particularly advantageous if the cone pairs are offset from one another such that the wire travels on a plane lying perpendicular to rotation axes of the cones during a transfer from one cone pair to the next cone pair. It is thus prevented that the wire must travel at an incline to the rotation axes during the transfer, which could cause additional tensions and loads.

The individual cone pairs are preferably arranged in multiple chambers, wherein the chambers can be flooded with a liquid separately from one another. Ordinarily, three to five cone pairs are provided. The first two cone pairs in particular can then be arranged in a shared chamber. Because of the leak-tightness of the chambers, a liquid lubricant and coolant can be applied to these chambers in order to, on the one hand, facilitate a passage through the drawing dies and, on the other hand, to dissipate the deformation heat produced by the deformation.

After the last cone pair, at least one end drawing die can be provided which performs a final deformation. It is preferred that two end drawing dies are provided, wherein the end drawing dies are spaced apart from one another. This makes it possible to measure the drawn wire, in particular the diameter thereof, in the region of the last drawing die. The last end drawing die performing a deformation can be rotatably positioned by means of a holder so that the wire can be fed to downstream units on an adjustable plane.

Preferably, a drawing-out disc is arranged downstream from the last cone pair, which disc is preferably operated without slip. The drawing-out disc can be arranged such that the wire extends from the last cone pair on a plane lying perpendicular to the rotation axes of the last cone pair and the drawing-out disc.

To avoid a device-related cost, it is preferably provided that the drawing-out disc and the last cone pair are connected to the same motor and can be driven by this motor. The number of the necessary motors is thus reduced with a simultaneously good controllability of the process. Particularly in terms of the process management, a regulation can be provided with which a rotational speed regulation of the motors occurs as a function of a rotational speed of the drawing-out disc. In addition, a testing disc can be arranged downstream from the drawing-out disc, with which testing disc a defined test load can be applied to the wire. This allows the wire to be tested immediately for suitability for use. It is thereby also advantageous if the applied test load is maintainable as a function of the rotational speed of the drawing-out disc, in particular by means of a corresponding regulation. The test load can then be adjusted to the rotational speed of the drawing-out disc and therefore to the wire speed.

Both the drawing-out disc and also the testing disc can be equipped on a front face with a co-rotating disc which comprises openings through which a suctioning of air occurs when the disc rotates. The rotation of the drawing-out disc or the testing disc, which rotation is necessary in any case, is thus utilized in order to cool the discs themselves, but also the wire traveling over these discs, in a natural manner. This can occur in a particularly efficient manner if the drawing-out disc and/or the testing disc are arranged in closeable chambers, wherein the chambers comprise a corresponding recess in the region of the disc or discs. Air is then suctioned, as in the case of a fan, from the outside, which air produces the desired cooling.

A regulation of the individual motors in the motor cluster can then be achieved particularly easily if the motors are servomotors. Constant tensile stresses in the wire path can then be set within a narrow range at the transition between the individual cone pairs so that no wire tear occurs due to overloading. Any individual torque changes occurring are measured so that re-adjustment is also possible as needed. For this purpose, it can be provided that predefined nominal torques are stored or that comparative torques are configured as differences between adjacent drives or cone pairs, which differences serve as reference values.

Figure 2:
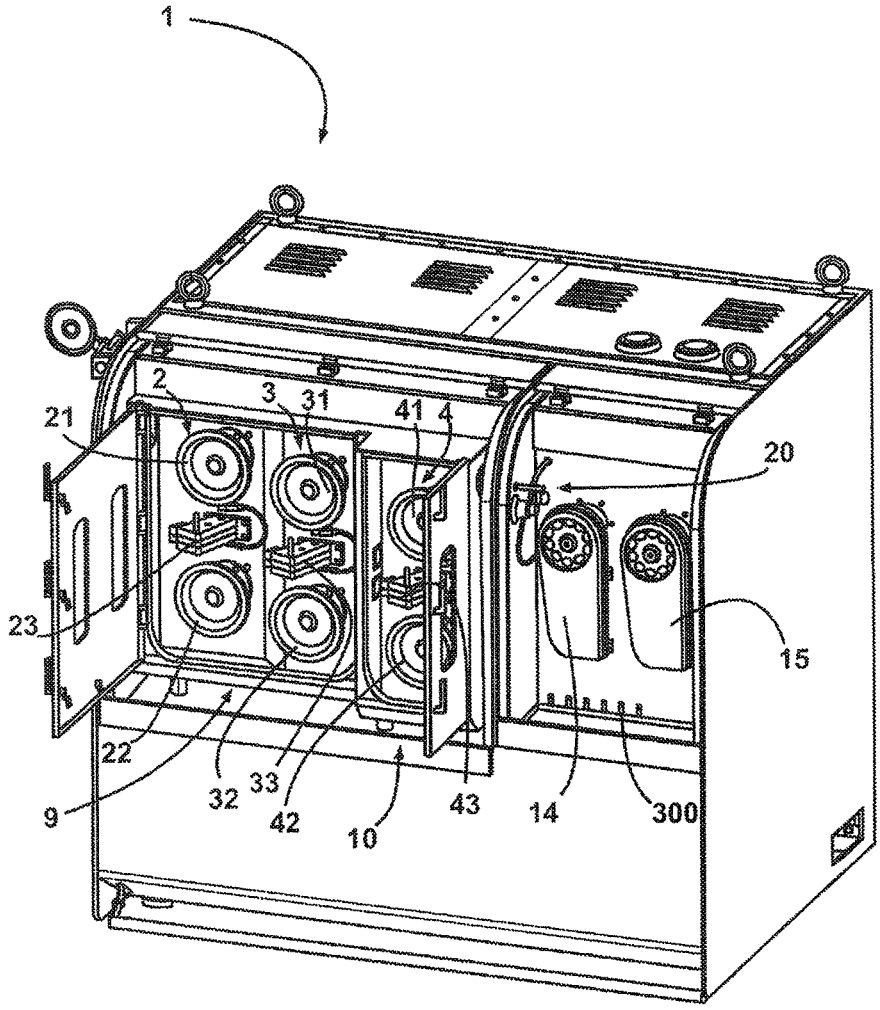
Figure 3:
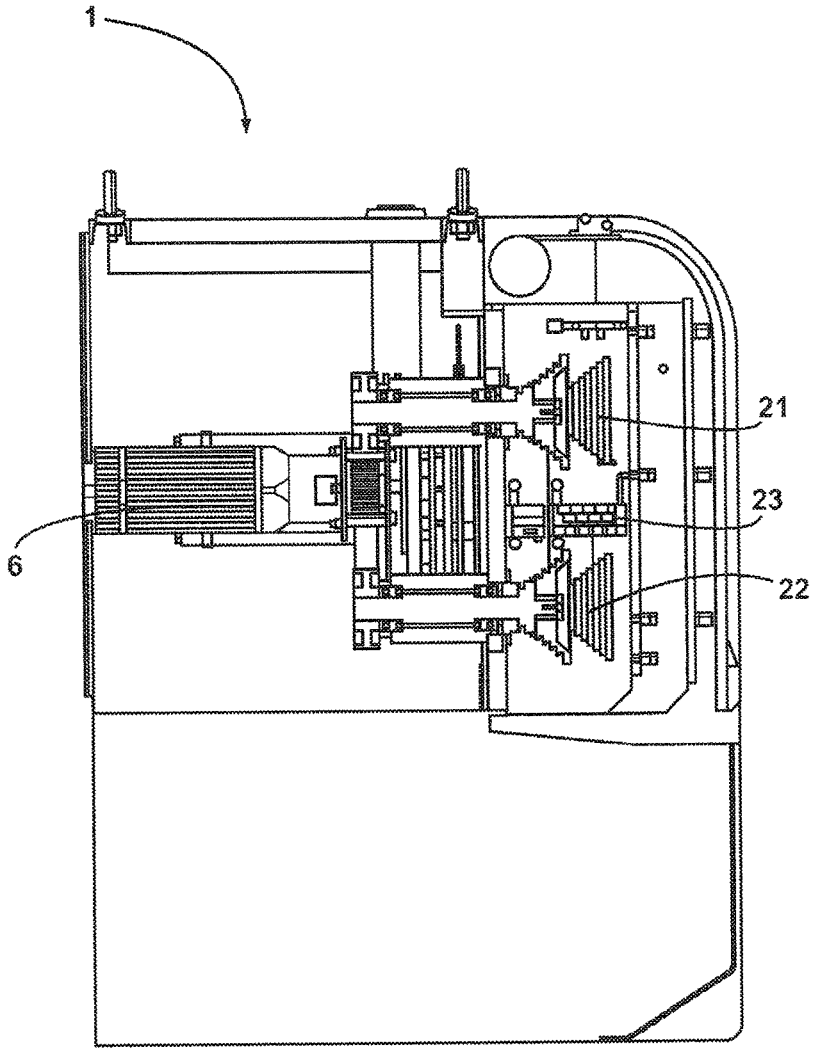
Figure 4:
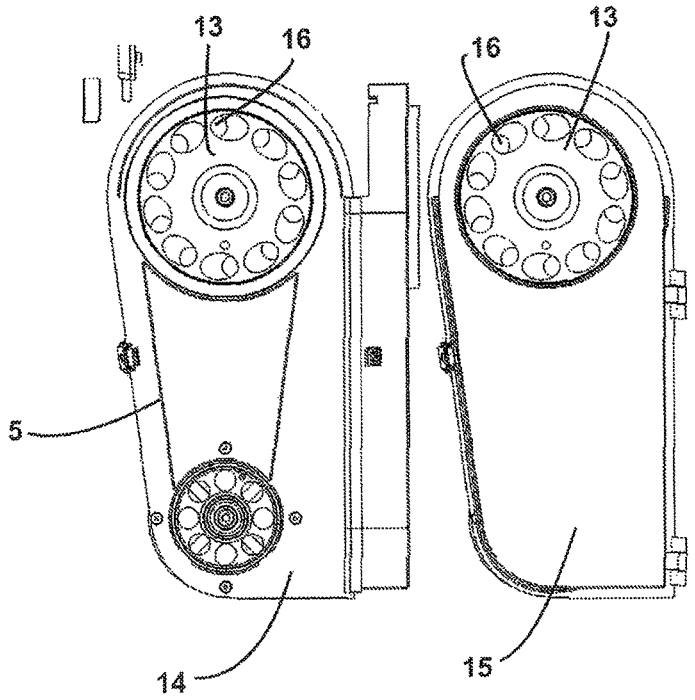
Figure 5:
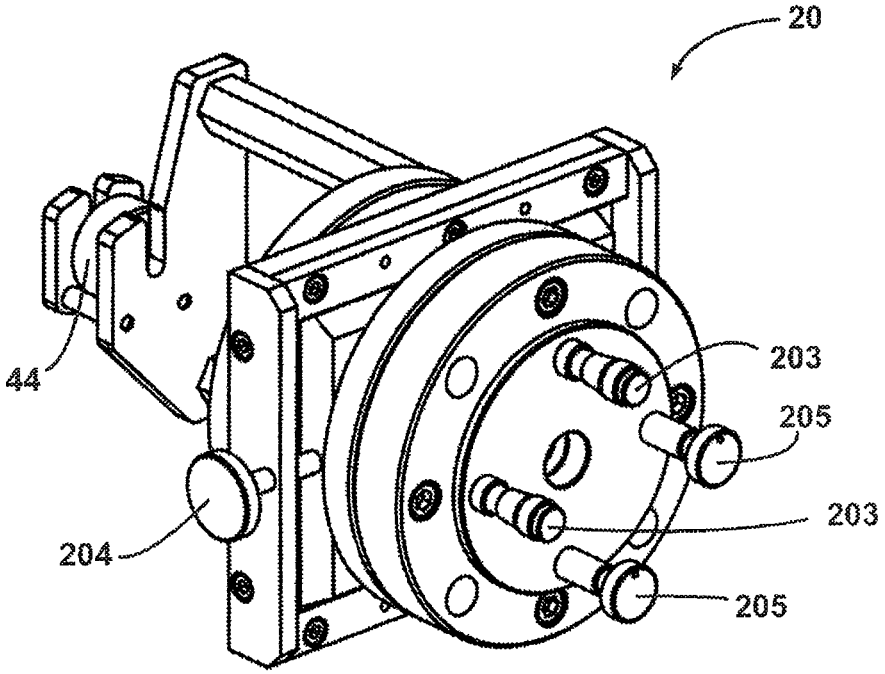
Figure 6:
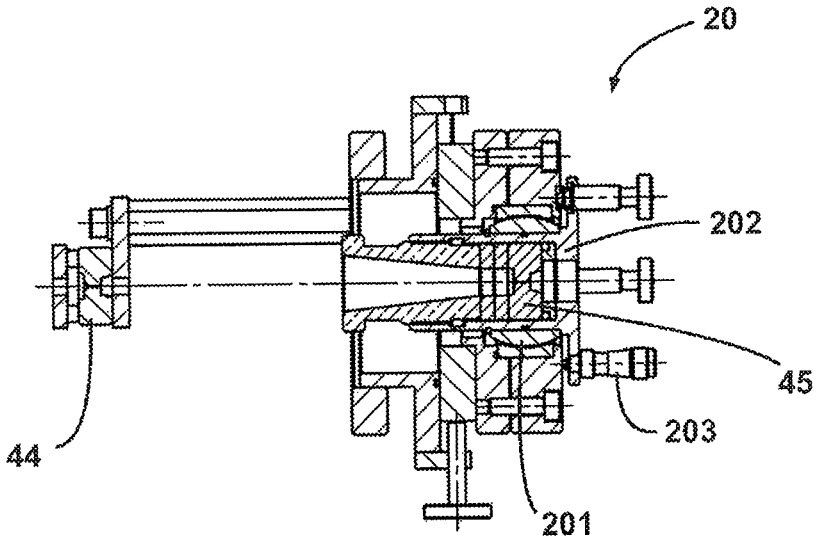
Figure 7:
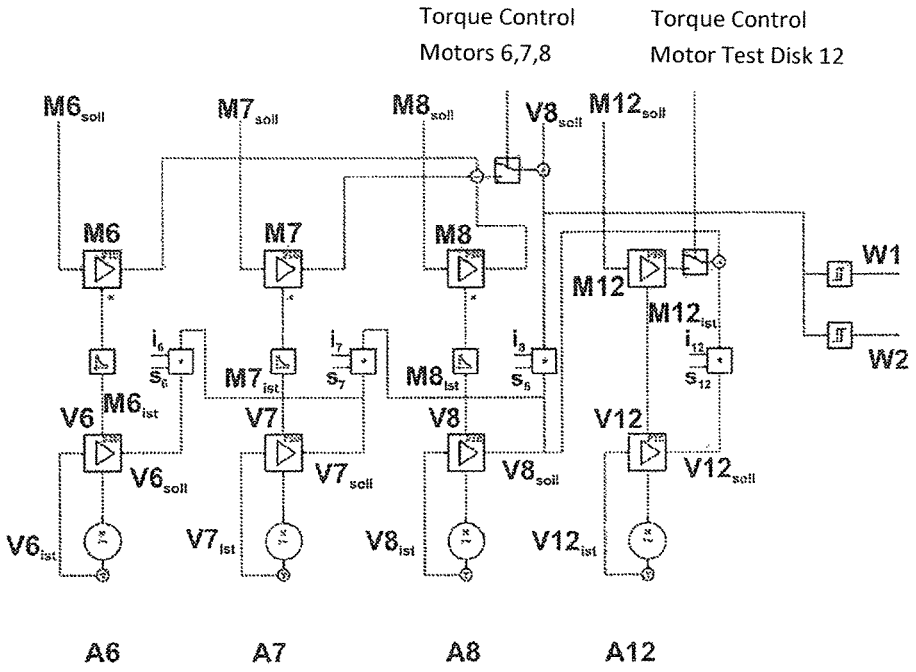

Additional features, benefits and effects of the invention are derived from the following exemplary embodiment of the same. The drawings which are thereby referenced show the following:

FIG. 1 A schematic representation of a device according to the invention;

FIG. 2 An exemplary embodiment of a device according to the invention in a perspective representation;

FIG. 3 A cross section through a device from FIG. 2 according to the invention;

FIG. 4 An enlarged representation of a part of a device according to the invention;

FIG. 5 An end drawing die holder;

FIG. 6 A cross section of an end drawing die holder according to FIG. 5;

FIG. 7 A regulation diagram.

In FIG. 1, a schematic representation of a device 1 according to the invention is shown, with which device a preferably patented steel wire is typically drawn to a final wire diameter of less than 0.2 mm, in particular 0.08 mm to 0.16 mm. The device 1 comprises a housing in which the preferably three to five cone pairs 2, 3, 4 are arranged in a row or in series. The first cone pair 2 comprises two cones 21, 22 arranged above one another. Analogously, the cone pairs 3, 4 arranged downstream likewise respectively comprise two cones 31, 32, 41, 42 arranged above one another.

Between the individual cones 21, 22, 31, 32, 41, 42 of a cone pair 2, 3, 4, drawing die holders with drawing dies 23, 33, 43 are arranged, through which wire 5 is drawn which is drawn off from a spool and fed to the device 1 and drawn by this device. By means of the drawing die holders with drawing dies 23, 33, 43, the diameter of the wire which is fed through, typically a steel wire, is reduced continuously, wherein deformation heat is produced. The cross-sectional decreases at the first two cone pairs 2, 3 typically lie within the range of 13% to 18% and are approximately 1% to 3% less at the third cone pair 4. Each drawing die holder holds at least one drawing die 23, 33, 43, but usually multiple drawing dies.

In a manner to be explained below, each individual cone pair 2, 3, 4 is driven by a motor 6, 7, 8 which is located respectively behind the cone pair 2, 3, 4. A drawing-out disc 11 is arranged downstream from the last cone pair 4, with which disc the wire 5 is drawn off from the last cone pair 4 with an additional cross-sectional reduction of approx. 8% to 12% and is fed to a testing disc 12 following another coiling revolution. The wire 5 is guided on the drawing-out disc 11 without slip. At the testing disc 12, a test load is applied in order to test the wire for suitability for use. The applied test load is variable and depends on the rotational speed of the drawing-out disc 11 or is regulated according to the rotational speed thereof. From the testing disc 12, which is also operated without slip, the wire 5 is ultimately fed via a placer 17 onto a winder 18, where a finished wire roll 19 can be removed upon completion. A dedicated motor is provided for the testing disc 12.

In FIGS. 2 and 3, a device 1 according to the invention is illustrated in detail. The device 1 comprises a housing which is essentially outwardly closed or closeable and which comprises all components for drawing the wire 5 with the exception of a placer 17 with a placer motor and a winder 18 with a winder motor. The latter components can be kept as an additional modular unit in a dedicated housing which connects to the housing shown in FIG. 2 in the wire draw direction and has identical dimensions in cross section. As can be seen from FIG. 2, the device 1 comprises three cone pairs 2, 3, 4 which are arranged in a row. Between the individual cones 21, 22, 31, 32, 41, 42, which rotate in the same direction, of the cone pairs 2, 3, 4, which are positioned at an equal height, one drawing die 23, 33, 43 is arranged respectively. The inwardly conically tapered cones 21, 22, 31, 32, 41, 42 are formed in one piece. The cone pairs 2, 3 are thereby kept in a first chamber 9 which is illustrated in an opened state in FIG. 2 for the purpose of clarity. During use, this first chamber 9 can be closed in a liquid-tight manner so that the chamber 9 can be flooded with a lubricant and coolant. Above all, this helps to lubricate the drawing dies and to dissipate deformation heat. A flooding of the chamber 9 can occur to above the drawing dies 23, 33. The other cone pair 4 is located in a second chamber 10 which is arranged downstream from the first chamber 9. Once again, at least one drawing die 43 is located between individual cones 41, 42. In addition, similar to the first chamber 9, the second chamber 10 can also be flooded with a lubricant and coolant, namely also variably to above the drawing die holder with the drawing die(s) 43. The lubricating liquids and cooling liquids necessary for flooding the chambers 9, 10, as well as the components for circulation, are arranged in a circuit inside the housing. Furthermore, a high-pressure drawing die flushing, not illustrated in greater detail, is provided with which the drawing dies 23, 33, 43 are individually flushed with a suitable lubricant under high pressure. Additionally, a device for applying ultrasound to the drawing dies 23, 33, 43 or the chambers 9, 10 can also be provided.

As can be seen in the perspective representation in FIG. 2, the individual cone pairs 2, 3, 4 are offset from one another such that the wire 5 that is to be drawn always travels on a plane lying perpendicular to the rotation axes of the cones 21, 22, 31, 32, 41, 42 during the transfer from one cone pair 2, 3 to the next cone pair 3, 4.

A drawing-out disc 11 is arranged downstream of the actual wet drawing device or at the cone pairs 2, 3, 4, which disc is arranged in a separate section, as is a testing disc 12 which is arranged downstream of drawing-out disc 11. By means of the drawing-out disc 11, the wire 5 is drawn off from the last cone pair 4 without slip, wherein a further cross-sectional reduction of approximately 8% to 12% can occur. After the wire 5 is guided in a coiling manner until a complete frictional fit is achieved, but is guided at least once in a coiling manner, this wire is fed to the testing disc 12, with which a defined testing load is applied to the wire 5. It is thus ensured that the wire 5 exhibits a required strength. The testing load that is applied by the testing disc 12 is regulated as a function of the rotational speed at the drawing-out disc 11 in order to account for the respective current circumstances. Furthermore, a stretching load is also advantageously applied via this arrangement, by means of which load the wire 5 is straightened and residual tensions can be effectively eliminated, for which reason none of the roller straighteners used in current practice are required, which straighteners frequently exhibit bearing damage after a brief period of use and are exposed to significant wear. The drawing-out disc 11 is arranged such that, similar to between the cone pairs 2, 3, 4, a plane is again formed between the last cone pair 4 and the drawing-out disc 11, which plane lies perpendicular to the rotation axis of the driving disc 11 and in which the wire 5 travels during the transfer.

The drive concept is illustrated in greater detail on the basis of FIG. 3. In cross section, a motor 6 can be seen which drives two shafts via a belt drive, on which shafts the cones 21, 22 of the first cone pair 2 are attached at the non-driving end. The motor 6 is a servomotor, in particular an asynchronous servomotor. Servomotors not only have the advantage of a precise controllability, they are also compact, energy efficient and do not require an outside cooling. The two cones 21, 22 are thus driven at the same angular velocity. Analogous motors 7, 8 are provided for driving the cone pairs 3, 4 (FIG. 1). For this purpose, each motor 6, 7, 8 is connected to the respective shafts without slip via synchronous toothed belt drives.

A regulation of the device 1 occurs via the drawing-out disc 11. A load torque ratio between two adjacent drives must not exceed a critical limit value, which would inevitably lead to wire breakage. As a result of a drawing die wear or diameter increases in the individual drawing dies 22, 23, 43, however, torque changes occur which are measured, or are transmitted by the servomotors, and corrected if necessary by a re-adjustment of the rotational speeds. For this purpose, the rotational speed of the drawing-out disc 11 is calculated, which as a rule must be equal to a predefined setpoint value (a maximum production rotational speed, in the ideal case). In the event of corresponding deviations from the setpoint value, a regulation of the servomotors 6, 7, 8 respectively arranged upstream occurs so that, on the one hand, a slip minimization is achieved at the cones 2, 3, 4 and, on the other hand, a minimization of the wire loading is achieved.

In FIG. 4, chambers 14, 15 are shown in greater detail in which the drawing-out disc 11 and the testing disc 12 are each arranged separately. In addition to the drawing-out disc 11 or the testing disc 12, the chambers respectively comprise a guiding unit arranged thereunder, so that the wire in the chambers 14, 15 is guided in a coiling manner similar to how it is guided around the cone pairs 2, 3, 4. At the drawing-out disc 11 or the testing disc 12, a disc 13 is respectively arranged on a front face, which disc comprises at a circumferential end a plurality of openings 16 arranged in a circle, which openings are shaped such that air is suctioned during a rotation of the drawing-out disc 11 or of the testing disc 12. This air is conducted onto the drawing-out disc 11 or testing disc 12 positioned therebehind so that air is constantly applied to the wire 5, and also to the drawing-out disc 11 and the testing disc 12, during operation. If a particularly uniform application of air is required, additional discs can also be arranged behind the discs 13, which additional discs comprise planar bars running in the direction of the rotation axis, which bars are positioned between the openings 16. The suctioned air is thus directed in a highly uniform manner towards the parts that are to be cooled. To achieve a highest possible efficiency during the suctioning or to increase a cooling effect, the chambers 14, 15 respectively comprise a door, with which the chambers 14, 15 can be closed. However, the doors have a recess or opening, the diameter and position of which corresponds to that of the discs 13, so that air can be suctioned from the outside, conducted onto the parts that are to be formed, and circulated in the chambers 14, 15, before the air escapes again via an opening which is not depicted.

Furthermore, the device 1 advantageously has a leakage indicator 300 for monitoring the leak-tightness of the cone shafts and for preventing the drawing agent from entering the bearings with subsequent bearing damage. For this purpose, an intermediate chamber is provided in the region of a sealing unit and a shaft bearing, via which chamber the leak flow of a drawing agent is drained in a collected manner and guided into indicator containers via lines which are each distinctly assigned to the sealing unit, whereby a leaking shaft bearing becomes clearly identifiable for a device operator and, if necessary, suitable measures can be taken in order to specifically counteract costly bearing damage subsequently occurring in the event of an unidentified leak flow. Lengthy downtimes can thus be effectively avoided.

In FIGS. 5 and 6, an end drawing die holder 20 is illustrated in greater detail. The end drawing die holder 20 is attached at the transition of the second chamber 10 to the part of the device 1 in which the chambers 14, 15 are positioned (FIG. 2). The end bearing die holder 20 comprises two end drawing dies 44, 45 spaced apart from one another. The final deformation steps occur using these end drawing dies 44, 45. The spacing of the two end drawing dies 44, 45 offers several advantages: On the one hand it has, somewhat surprisingly, been shown that as a result of the spacing of the end drawing dies 44, 45, the wire 5 can be produced with improved strength properties and a better surface quality. On the other hand a diameter of the wire 5 can be measured between the end drawing die holders 44, 45 immediately prior to the final deformation step. From the diameter of the wire 5, a wear in the drawing die 44 can be deduced, from which a current ratio of the distribution of the cross-sectional decreases then directly results and can thus be controlled and monitored.

As follows in particular from a review of both FIG. 5 and FIG. 6, not only does the end drawing die holder 20 comprise end drawing dies 44, 45 which are separate from one another, but rather the second and final end drawing die 45 is also positioned in a rotatable and horizontally displaceable manner. For the corresponding rotation, a hemispherical slide bearing 201 is provided on which a component 202 holding the second end drawing die 45 is rotatably positioned. By means of corresponding setting screws 203, 204 or, generally, setting elements with a permanently affixed scale graduation (Vernier scale), the last end drawing die 45 can thus be accurately rotated at an angle and horizontally displaced or adjusted and fixed in the adjusted position using fixing elements 205. In particular, an adjustment is thereby performed such that the wire 5 from the last end drawing die 45 runs onto the drawing-out disc 11 in a straight line. This means that the wire 5 can be guided onto the drawing-out disc 11 on a plane perpendicular to the rotation axis of this disc. This is a significant advantage, as wire tensions and potential wire tears are thus avoided. For this purpose, the end drawing die holder 20 is expediently arranged above the first chamber 14 or the drawing-out disc 11 held in this chamber, as this can be seen in FIG. 2. Thus all transition regions between the cone pairs 2, 3, 4, as well as the end drawing die holder 20 and drawing-out disc 11 as well as the testing disc 12 each lie on a plane perpendicular to the respective rotation axes.

In FIG. 7, a regulation diagram for controlling the individual motors 6, 7, 8 and a motor for the testing disc 12 is illustrated. The drive systems A6, A7, A8, A12 comprise the motors 6, 7, 8 and the separate motor for the testing disc 12. The reference characters M6, M7, M8, M12 are assigned to a torque regulation of the individual drives A6, A7, A8, A12 with the motors 6, 7, 8 and the testing disc motor; the reference characters V6, V7, V8, V12 are assigned to a speed regulation. The transmissions $i_6$, $i_7$, $i_8$, $i_{12}$ and the slip factors $s_6$, $s_7$, $s_8$, $s_{12}$ are indicated accordingly.

To limit the disadvantageous case of a continuous slip accumulation across all stages of the deformation and to be able to autonomously perform all adjustments of the device 1 via the regulation thereof, wherein additional sensors can be completely omitted and the device 1 nevertheless produces in a manner adjusted to an optimal operating state, a regulation or control according to FIG. 7 is provided. To regulate a reduced-slip operation of the device 1 or of a wet drawing machine, a decoupling of the individual drawing stage groups is structurally provided, which decoupling occurs via a separate drive by asynchronous servomotors. A load distribution is thereby adjusted via suitable parameters. The motors 6, 7, 8 are operated via servo controllers and are equipped with a feedback in the form of absolute value transmitters (encoders) or resolvers.

Unlike a frequency converter, a servo controller has vastly quicker intervention options, since along with the voltage amplitude and the frequency, a phasing of the current can also be modified. In particular, through the option of interfering with the phasing, very quick current modifications, and therefore torque modifications, are possible. This is also a prerequisite for a dynamic drive behavior, which is necessary if the overlaid rotational speeds or torques are supposed to be or need to be dynamically adjusted. The servo control concept used for the device 1 occurs by means of a storage of a motor model in the servo controller so that the magnetizing component and the active component of the motor current can be regulated independent of one another. The dynamic characteristics of the controller are thus significantly improved.

Since, for functional reasons, the drawing process with a device 1 is always to be operated with a certain slip, it is expedient to provide a base slip on the order of approximately 2% across the individual geometries. The startup of the device 1 is therefore carried out using a pure rotational speed control. The regulation of the rotational speeds thereby occurs in a simple manner via the rotational speed of the drawing-out disc 11, which specifies a reference setpoint value or a maximum production speed. During the startup, the testing disc 12 can already be driven via the torque to achieve optimal wire qualities. Then, once stable production conditions have been achieved, it is expediently possible to change over into a torque-controlled operation of the motors 6, 7, 8. This transition can be performed manually or automatically. Although a complete frictional connection must not occur during a sliding drawing process, since otherwise a wire tear inevitably occurs in the device 1 and a slip measurement is also not possible, as no suitable systems are available on the market in this regard which can metrologically capture the wire speed at all drawing stages, an adjustment to changing conditions (process parameters and/or changes in tool condition), and therefore an optimized product speed, can be achieved using the speed information or torque information or the corresponding shafts without sensor systems while avoiding a wire tear.

With a regulation diagram according to FIG. 7, the following process can be implemented for a device 1:

- Startup of the device 1 with a predefined rotational speed, which is determined for all cones 21, 22, 31, 32, 41, 42 via the rotational speed of the drawing-out disc 11;
- operation of the device 1 in the region guided by the rotational speed until stable production conditions are achieved;
- subsequently an optional changeover into an operation of the motors 6, 7, 8 which is guided by rotational speed.

The invention claimed is:

1. A device for drawing wire, comprising:

multiple cone pairs arranged in a row;

drawing dies arranged between cones of the cone pairs, wherein wire that is to be drawn runs from one cone pair to a next cone pair;

a motor provided for each of the cone pairs in order to drive respective cone pairs, wherein the cones of the cone pairs are arranged above one another;

a drawing-out disc is arranged, with respect to a process direction, downstream of a last cone pair of the cone pairs; and a testing disc is arranged, with respect to the process direction, downstream of the drawing-out disc to apply a defined test load to the wire, wherein the test load is variable and depends on a rotational speed of the drawing-out disc; and wherein the drawing-out disc and the testing disc are arranged in separate closeable chambers, wherein a first of the separate closeable chambers comprises a first closeable door having a first opening in a region of the drawing-out disc and a second of the separate closeable chambers comprises a second closeable door having a second opening in a region of the testing disc.

2. The device according to claim 1, wherein individual cones of the cone pairs are embodied in one piece or in multiple pieces.

3. The device according to claim 1, wherein the cone pairs are offset from one another so that the wire travels on a plane lying perpendicular to rotation axes of the cones during a transition from one cone pair to the next cone pair.

4. The device according to claim 1, wherein the cone pairs are arranged in multiple chambers, wherein the chambers can be flooded with a liquid separately from one another.

5. The device according to claim 1, wherein at least one end drawing die is provided after the last cone pair.

6. The device according to claim 5, wherein two end drawing dies are provided, wherein the end drawing dies are spaced from one another.

7. The device according to claim 5, wherein a last end drawing die of the at least one end drawing die performing a deformation is rotatably positioned via a holder.

8. The device according to claim 1, wherein the drawing-out disc and the last cone pair are connected to and driven by a same motor.

9. The device according to claim 1, wherein a regulation is provided with which a rotational speed regulation of the motors occurs as a function of a rotational speed of the drawing-out disc.

10. The device according to claim 1, wherein the applied test load is maintainable by the testing disc as a function of the rotational speed of the drawing-out disc.

11. The device according to claim 1, wherein at least one of the drawing-out disc and the testing disc is equipped on a front face with a co-rotating disc which comprises disc openings through which a suctioning of air occurs when the co-rotating disc rotates.

12. The device according to claim 1, wherein the drawing-out disc and the testing disc are each equipped on a front face with a co-rotating disc having disc openings through which a suctioning of air occurs when the co-rotating disc rotates.

13. The device according to claim 1, wherein the motors are servomotors.

14. The device according to claim 1, wherein the testing disc additionally applies a stretching load to the wire.

15. The device according to claim 1, wherein the drawing-out disc and the testing disc are each equipped with a respective co-rotating disc having disc openings through which a suctioning of air occurs when the respective co-rotating discs rotate, the respective co-rotating discs being arranged in the closeable chambers.

* * * * *